US009233560B2

(12) United States Patent
Yanase et al.

(10) Patent No.: US 9,233,560 B2
(45) Date of Patent: Jan. 12, 2016

(54) IMAGE FORMING APPARATUS AND METHOD WHICH CONTROLS A POWER OF ADSORPTION WHICH HOLDS A PRINTING MEDIUM

(71) Applicants: Norikazu Yanase, Kanagawa (JP); Kazuyoshi Matsumoto, Tokyo (JP); Makoto Kikura, Kanagawa (JP); Kazuyoshi Kondoh, Tokyo (JP); Yuuzoh Obata, Tokyo (JP); Gaku Hosono, Kanagawa (JP)

(72) Inventors: Norikazu Yanase, Kanagawa (JP); Kazuyoshi Matsumoto, Tokyo (JP); Makoto Kikura, Kanagawa (JP); Kazuyoshi Kondoh, Tokyo (JP); Yuuzoh Obata, Tokyo (JP); Gaku Hosono, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/485,289

(22) Filed: Sep. 12, 2014

(65) Prior Publication Data

US 2015/0077459 A1 Mar. 19, 2015

(30) Foreign Application Priority Data

Sep. 17, 2013 (JP) ..... 2013-191561
Jun. 12, 2014 (JP) ..... 2014-121128

(51) Int. Cl.
*B41J 29/38* (2006.01)
*B41J 11/00* (2006.01)

(52) U.S. Cl.
CPC ..... *B41J 11/0085* (2013.01); *B41J 11/007* (2013.01)

(58) Field of Classification Search
CPC ..... B41J 29/38; B41J 11/0085
USPC ..... 347/16
See application file for complete search history.

(56) References Cited

U.S. PATENT DOCUMENTS 5,437,228 A * 8/1995 Uland ..... 101/288
8,783,855 B2 * 7/2014 Toya ..... 347/104
2003/0230844 A1 * 12/2003 Shimoyama ..... 271/127

FOREIGN PATENT DOCUMENTS

JP 2002-179313 6/2002
JP 2002179313 A * 6/2002 ..... B65H 29/24
JP 2004-122494 4/2004
JP 2009-234013 10/2009
JP 2012-056243 3/2012

* cited by examiner

*Primary Examiner* — Alessandro Amari
*Assistant Examiner* — Michael Konczal
(74) *Attorney, Agent, or Firm* — Oblon, McClelland, Maier & Neustadt, L.L.P.

(57) ABSTRACT

An image forming apparatus includes an image forming device to form an image on a print medium by a reciprocation operation of a print head. There is a conveying device including a belt that holds the print medium, a fan that adsorbs air through suction holes in the belt, and a fan drive controller that drives the suction fan and adjusts power of adsorption of the suction fan. The fan drive controller performs control which makes the power of adsorption for the first reciprocation movement of the image forming device stronger than the power of adsorption for the second reciprocation movement of the image forming device.

14 Claims, 8 Drawing Sheets

IMAGE FORMING APPARATUS AND METHOD WHICH CONTROLS A POWER OF ADSORPTION WHICH HOLDS A PRINTING MEDIUM

CROSS-REFERENCE TO RELATED APPLICATIONS

This patent application is based on and claims priority pursuant to 35 U.S.C. §119 to Japanese Patent Application Nos. 2013-191561, filed on Sep. 17, 2013, 2014-121128, filed on Jun. 12, 2014 in the Japan Patent Office, the entire contents of each of which are hereby incorporated by reference herein.

BACKGROUND

1. Technical Field

Embodiments discussed herein relate to an image forming apparatus, particularly to an image forming apparatus using a rolled print medium.

2. Related Art

An image forming apparatus, such as a label printer, performs printing on a print medium having an adhesive surface with no release liner attached thereto, such as adhesive tape or a label sheet with no backing sheet (hereinafter also referred to as a linerless label sheet), and thereafter cuts the print medium into print medium pieces (hereinafter also referred to as label pieces) of a desired length.

An image forming apparatus, which conveys a print medium while adsorbing the print medium on a platen by a suction fan and reduces power of adsorption by the suction fan just before conveying operation in order to reduce the conveying load for the print medium, is known.

When a rolled print medium is used, the curvature of a leading edge portion of print medium occurs for a peculiar winding curl of the print medium which is held as a roll body. Especially in the case of using the rolled linerless label sheet, the leading edge portion of the print medium curls easily by a tearing off force because the adhesive surface of the print medium is held adhering to the roll body itself. Therefore, when using a linerless label sheet, the curl of the leading edge portion of the print medium 2 occurs easily, and the amount of curl is large.

When the image formation operation is performed using the print medium which has a curl in the leading edge portion, the print medium rubs the recording heads and degradation of image quality and a paper jam occur.

SUMMARY

Accordingly, one aspect of the present disclosure provides an improved image forming apparatus that includes an image forming device configured to form an image on a print medium by a reciprocation operation of a print head, and a conveying device configured to hold an image forming surface of the print medium and to convey the print medium. The conveying device includes a belt that holds the print medium, a suction fan that adsorbs air through adsorption holes arranged in the belt, and a fan drive controller that drives the suction fan and adjusts power of adsorption by the suction fan. The fan drive controller controls the power of adsorption for the first reciprocation movement of the image forming device to be stronger than the power of adsorption for the second reciprocation movement of the image forming device.

BRIEF DESCRIPTION OF THE DRAWINGS

A more complete appreciation of the present invention and the advantages thereof will be understood by reference to the following detailed description, when considered in connection with the accompanying drawings, wherein.

DETAILED DESCRIPTION

Figure 1:
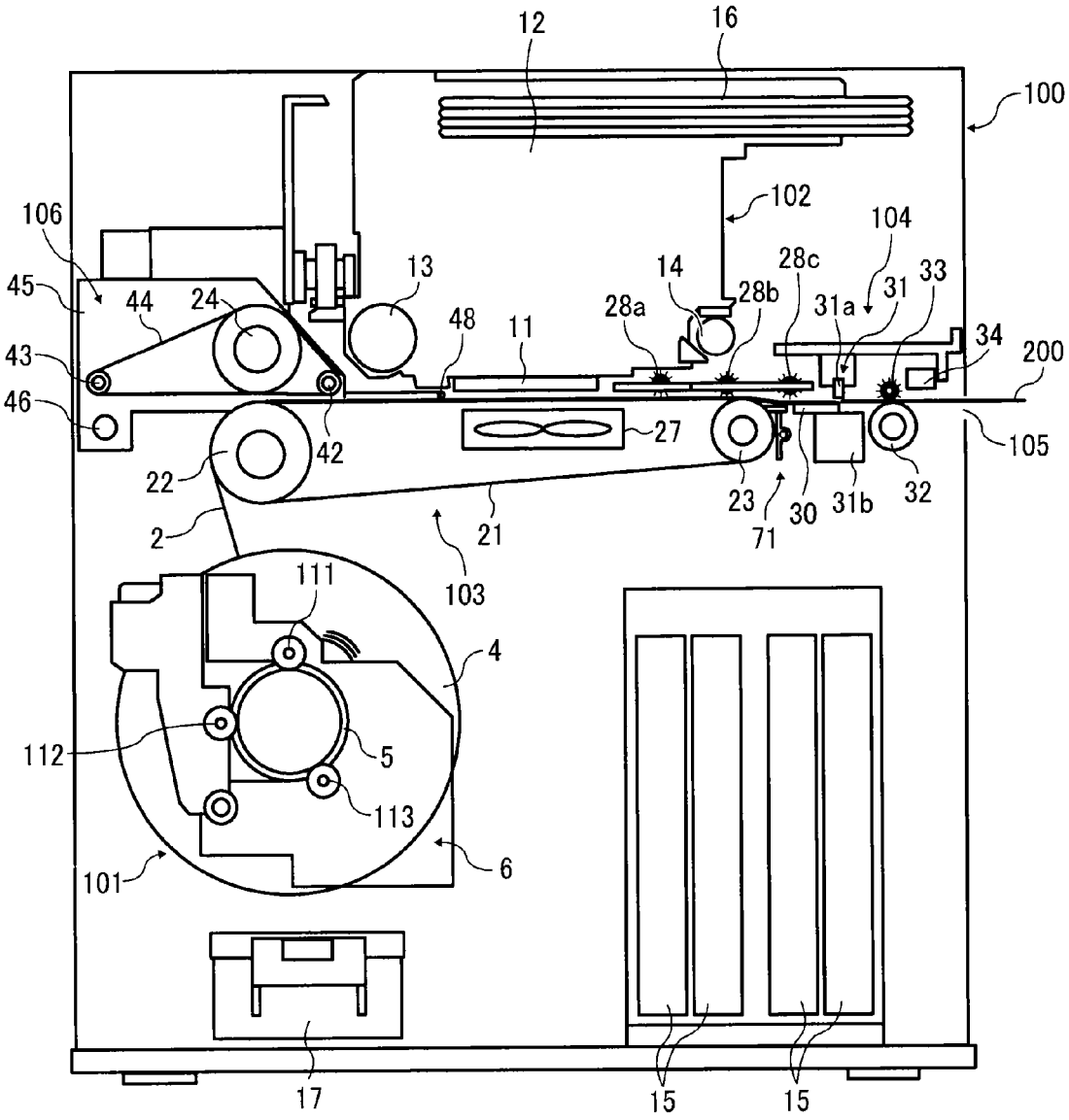
FIG. 1 is a front view of a mechanical section of an image forming apparatus according to one embodiment of the present disclosure.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Figure 2:
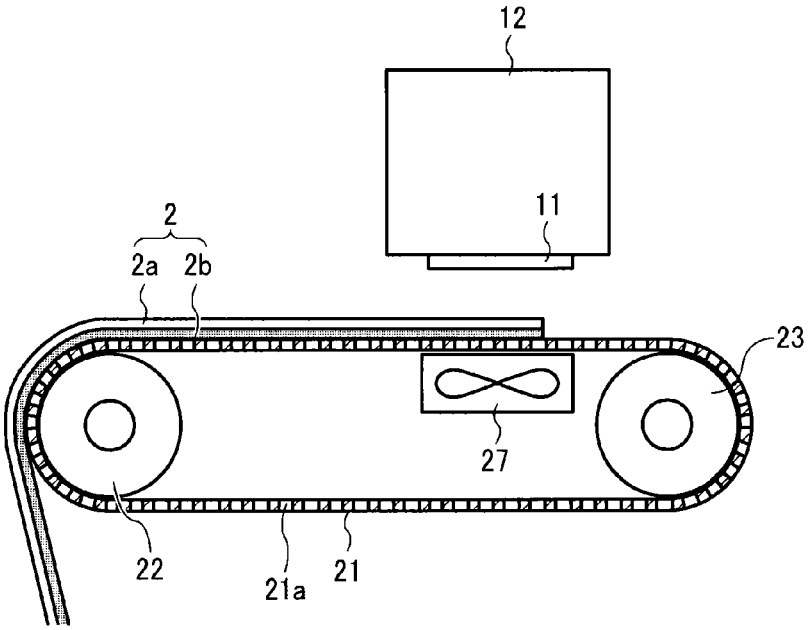
FIG. 2 is a side view of a printing medium in the image forming apparatus according to one embodiment of the present disclosure.

Referring now to the drawings, wherein like reference numerals designate identical or corresponding parts throughout the several views, embodiments of the present disclosure will be described. With reference to FIGS. 1 and 2, an image forming apparatus according to a first embodiment of the present disclosure will be described. FIG. 1 is a front view of a mechanical section of the image forming apparatus. FIG. 2 is a side view of a printing medium in the image forming apparatus.

The image forming apparatus includes an apparatus body 100 including a sheet feeding unit 101 (i.e., a sheet feeding device), an image forming unit 102 (i.e., an image forming device), a conveyance unit 103 (i.e., a conveyance device), a sheet discharging unit 104 (i.e., a sheet discharging device), a guiding device 106, ink cartridges 15, a waste liquid tank 17, and a discharge opening 105. The guiding device 106 guides a print medium 2 (also referred to as a recording medium or a sheet) during conveying or rewinding of the print medium 2.

The print medium 2 is wound in a roll 4, which is installed in the sheet feeding unit 101. As illustrated in FIG. 2, in the present embodiment, the print medium 2 is a continuum of image-formable media having a rear surface with an adhesive layer. Hereinafter, the image-formable medium and the adhesive layer will be referred to as the printing surface 2*a* and the adhesive surface 2*b*, respectively. Specifically, the print medium 2 is a rolled linerless label sheet with no backing sheet (i.e., release liner or separator) attached to the adhesive surface 2*b*. In addition, the kind of print medium 2 is not limited to the rolled linerless label sheet, and can be applied to the image forming apparatus using a common print medium (a cut sheet is included), such as rolled paper which is easy to cause a curl of a leading edge portion.

The sheet feeding unit 101 includes the roll 4, a spool 5, and two roll holders 6. FIG. 1 illustrate one of the two roll holders 6, i.e., the roll holder 6 on the front side of the apparatus body 100.

The roll 4 is fitted around the spool 5. The spool 5 has opposed end portions rotatably held at three points by the first roller 111, the second roller 112, and the third roller 113 provided in each of the roll holders 6.

In the present specification, the term "spool" is not limited to a member provided separately from a core member of the roll 4, and may also refer to a member formed integrally with the core member of the roll 4 and configured to be held by the roll holders 6. If the core member of the roll 4 is directly held by the roll holders 6, such a core member serves as a spool.

The image forming unit 102 includes a carriage 12, two recording heads 11, a main guide member 13, a sub-guide member 14, and supply tubes 16. The recording heads 11, which are liquid ejection heads that eject liquid droplets onto the print medium 2, are mounted on the carriage 12. If desired, only one or more than two heads which print may be used. The carriage 12 is movably held by the main guide member 13 and the sub-guide member 14 to move from side to side in a main scanning direction substantially perpendicular to the direction of conveying the print medium 2.

The present embodiment uses as the recording heads 11, two liquid ejection heads each including two nozzle rows to eject ink droplets of black, cyan, magenta, and yellow colors from four nozzle rows. The recording heads 11, however, are not limited thereto, and may be line heads. Inks of the respective colors are supplied as necessary from the ink cartridges 15 replaceably installed in the apparatus body 100 to head tanks of the carriage 12 through the supply tubes 16, and then to the recording heads 11. Waste ink resulting from, for example, a maintenance operation for maintaining and restoring the performance of the recording heads 11 is discharged to and stored in the waste liquid tank 17 replaceably installed in the apparatus body 100. In the image forming unit 102, the form of the recording heads 11 (i.e., liquid ejection heads) is not limited, as described above. Further, various types of image forming devices that form an image on a print medium in a contact or non-contact manner are applicable to the image forming unit 102, such as an impact printer.

The conveyance unit 103 includes an endless protective belt 21, a conveyance roller 22 (i.e., a conveyance rotary member), a driven roller 23, a facing roller 24, a suction fan 27, and spur roller groups 28*a*, 28*b*, and 28*c* illustrated in FIG. 1. The protective belt 21 serving as a conveyance belt is disposed below the recording heads 11, and is rotatably stretched taut around the conveyance roller 22 and the driven roller 23. Preferably, the protective belt 21 is not adhered to the adhesive surface 2*b* of the print medium 2. The protective belt 21, however, may have weak adhesiveness to the adhesive surface 2*b* of the print medium 2 to prevent the print medium 2 from separating from the protective belt 21 during the conveyance of the print medium 2 (hereinafter referred to as the medium conveyance operation) and separate from the print medium 2 after the medium conveyance operation. According to one embodiment, the belt has a base material which is a polyimide resin having a ceramic coating on the outer surface. Received by the protective belt 21, the adhesive surface 2*b* of the print medium 2 is protected and prevented from coming into contact with other components inside the apparatus body 100. Thereby, stable conveyance performance is obtained. Further, due to the separability of the protective belt 21 from the adhesive surface 2*b* of the print medium 2, the print medium 2 is reliably sent to the next process. That is, the protective belt 21 of the present embodiment functions as a conveyance belt and also as a protector of the adhesive surface 2*b* of the print medium 2.

The facing roller 24 is disposed facing the conveyance roller 22. The conveyance roller 22 and the facing roller 24 form a conveyance roller pair (i.e., a rotary member pair) serving as a conveyance device that clamps and conveys the print medium 2 and the protective belt 21 to an image forming area in which an image is formed by the recording heads 11. The protective belt 21 is formed with a multitude of suction holes. According to one embodiment, the suction holes are 3 mm in diameter and make up about 9% of the area of the belt. Inside a loop of the protective belt 21, the suction fan 27 is disposed facing the recording heads 11 of the image forming unit 102 via the protective belt 21. The suction fan 27 sucks the print medium 2 toward the outer circumferential surface of the protective belt 21 through the suction holes. The suction fan 27 may be implemented, for example, using Nidec fan 005F-24PH. When 24 volts is applied to this fan, it has a maximum air flow of 0.11 $m^3$/min, turns at 5,700 RPMs, and produces a maximum static pressure of 172 Pa.

Near the driven roller 23, the spur roller groups 28*a*, 28*b*, and 28*c* are disposed each of which includes a plurality of spur rollers aligned in a direction substantially perpendicular to the direction of conveying the print medium. The spur roller groups 28*a* and 28*b* located on the upstream side in the direction of conveying the print medium to face the protective belt 21, and the most downstream spur roller group 28*c* faces a receiving member 30 of the sheet discharging unit 104. Moreover, the separation nail or separation device 71 for separating the print medium 2 from the protection belt 21 is disposed downstream of a driven roller 23.

The sheet discharging unit 104 includes a receiving member 30, a cutter unit 31, a discharge roller 32, a spur roller group 33, and a sheet sensor 34. The receiving member 30 guides the print medium 2 sent thereto from between the protective belt 21 and the spur roller group 28*b*. The cutter unit 31 disposed downstream of the receiving member 30 in the direction of conveying the print medium serves as a cutting device that cuts the print medium 2 into print medium pieces, i.e., label pieces 200 of a desired length. The cutter unit 31 includes an upper cutter 31*a* and a lower cutter 31*b* formed by a downstream end surface of the receiving member 30 receiving the print medium 2. The upper cutter 31*a* moves in a direction substantially perpendicular to the medium conveying direction to cut the print medium 2 in conjunction with the lower cutter 31*b*.

The discharge roller 32 is disposed downstream of the cutter unit 31 in the direction of conveying the print medium to face the spur roller group 33 including a plurality of spur rollers aligned in a direction substantially perpendicular to the medium conveying direction. The discharge roller 32 and the spur roller group 33 hold the label piece 200 cut by the cutter unit 31, with a leading edge portion of the label piece 200 discharged to the discharge opening 105 of the apparatus body 100. In the present embodiment, the outer circumferential surface of the discharge roller 32 for holding the label piece 200 is treated, for example, with an anti-adhesive for preventing the adhesive surface 2*b* of the label piece 200 from adhering to the surface of the discharge roller 32, to thereby make the adhesive surface 2*b* of the label piece 200 separable from the surface of the discharge roller 32. In this case, the discharge roller 32 as a whole may be made of a material separable from the adhesive surface 2*b*. According to an embodiment, the discharge roller 32 has ethylene propylene rubber as a base material, with a surface coating of glass beads. The sheet sensor 34 detects the presence or absence of the print medium 2. The sheet sensor 34 may be a photosensor, a combination of a mechanical lever and a photosensor, or a combination of a mechanical lever and a position sensor, for example.

In the present embodiment, the guiding device 106 is constructed of the facing roller 24, a second roller 42, a third roller 43, an endless guide belt 44, a holder 45, and a shaft 46. The facing roller 24, which serves as a component of the conveying unit 103, as described above, also serves as a component of the guiding device 106. The second roller 42 serving as a separation roller is disposed downstream of the facing roller 24 serving as a first roller and upstream of the image forming unit 102 in the direction of conveying the print medium. The third roller 43 is disposed on the opposite side of the second roller 42 across the facing roller 24. The guide belt 44 is stretched around the facing roller 24, the second roller 42, and the third roller 43. In the present embodiment, the guide belt 44 is a belt member or belt including a base material made of polyimide and an outer circumferential surface formed with a release layer (e.g., a silicone coating) on the base material to improve the releasability of the guide belt 44 from the adhesive surface 2*b* of the print medium 2.

The facing roller 24, the second roller 42, and the third roller 43 are rotatably held by the holder 45. The holder 45 is disposed to be rotatable about the shaft 46 to allow the facing roller 24 to move between a position at which the facing roller 24 faces the convey roller 22 and a position at which the facing roller 24 is separated from the convey roller 22 to provide a space between the facing roller 24 and the convey roller 22. To install the roll 4 in the sheet feeding unit 101 and set the print medium 2 on the protective belt 21, the space between the facing roller 24 and the convey roller 22 is opened. To convey the print medium 2, the facing roller 24 is pressed against the convey roller 22. Therefore, the facing roller 24 is pressed against the convey roller 22 by a pressing device such as a spring. Similarly, the second roller 42 is also pressed against the protective belt 21 by a pressing device such as a spring.

As described above, the present embodiment is configured to perform image formation on the print medium 2 with the adhesive surface 2*b* facing the protective belt 21. Alternatively, the image formation may be performed on the adhesive surface 2*b* of the print medium 2. In this case, it is preferable that the outer circumferential surface of the guide belt 44 is treated with an anti-adhesive for preventing the adhesive surface 2*b* of the print medium 2 from adhering to the surface of the guide belt 44.

In the thus-configured image forming apparatus, the protective belt 21 and the print medium 2 unwound from the roll 4 installed in the sheet feeding unit 101 are set between the convey roller 22 and the facing roller 24. Then, the convey roller 22 is driven to rotate to convey the print medium 2 with the adhesive surface 2*b* protected by the protective belt 21, and a desired image is formed on the print medium 2 by the recording heads 11 of the image forming unit 102. The print medium 2 having the image formed thereon is then separated from the protective belt 21 and sent to the sheet discharging unit 104 to be cut into the label piece 200 at a predetermined position by the cutter unit 31. Thereby, the label piece 200 is held between the discharge roller 32 and the spur roller group 33 to be dischargeable from the discharge opening 105 of the apparatus body 100.

Particularly in a case in which the image is formed on the adhesive surface 2*b* of the print medium 2, the guiding device 106 prevents the print medium 2 from being caught in the facing roller 24 during the convey or rewinding of the print medium 2. Without the guide belt 44, the adhesive surface 2*b* of the print medium 2 may stick to and be caught in the outer circumferential surface of the facing roller 24 due to a relatively small curvature of the facing roller 24, even if the outer circumferential surface of the facing roller 24 is treated with an anti-adhesive. In this case, the curvature of the facing roller 24 may be increased to prevent such a convey failure. The increase in curvature of the facing roller 24, however, reduces the area of a clamp region between the facing roller 24 and the convey roller 22, making it difficult to obtain stable conveyance.

In the present embodiment, therefore, the print medium 2 in the conveyance operation is conveyed while being held by the guide belt 44, and is reliably separated from the guide belt 44 by the second roller 42 with a relatively large curvature serving as a separation roller. Thereby, the print medium 2 is prevented from being caught in the facing roller 24 in the conveyance operation of the medium. Also in the rewinding of the print medium 2 (hereinafter referred to as the medium rewinding operation), the guide belt 44 receives the adhesive surface 2*b* of the print medium 2 to prevent the print medium 2 from being caught in the facing roller 24.

After the image formation and the cutting of the print medium 2 by the cutter unit 31, a leading edge portion of the print medium 2 is located at the position of the cutter unit 31. If the next image forming operation starts in this state, a portion of the print medium 2 facing the image forming unit 102 will be wasted without being used (i.e., with no image formed thereon). To prevent this, the print medium 2 is rewound in a rewinding direction opposite to the direction of conveyance medium to a position at which the leading edge portion of the print medium 2 is located before (i.e., upstream of) the image forming unit 102.

Figure 3:
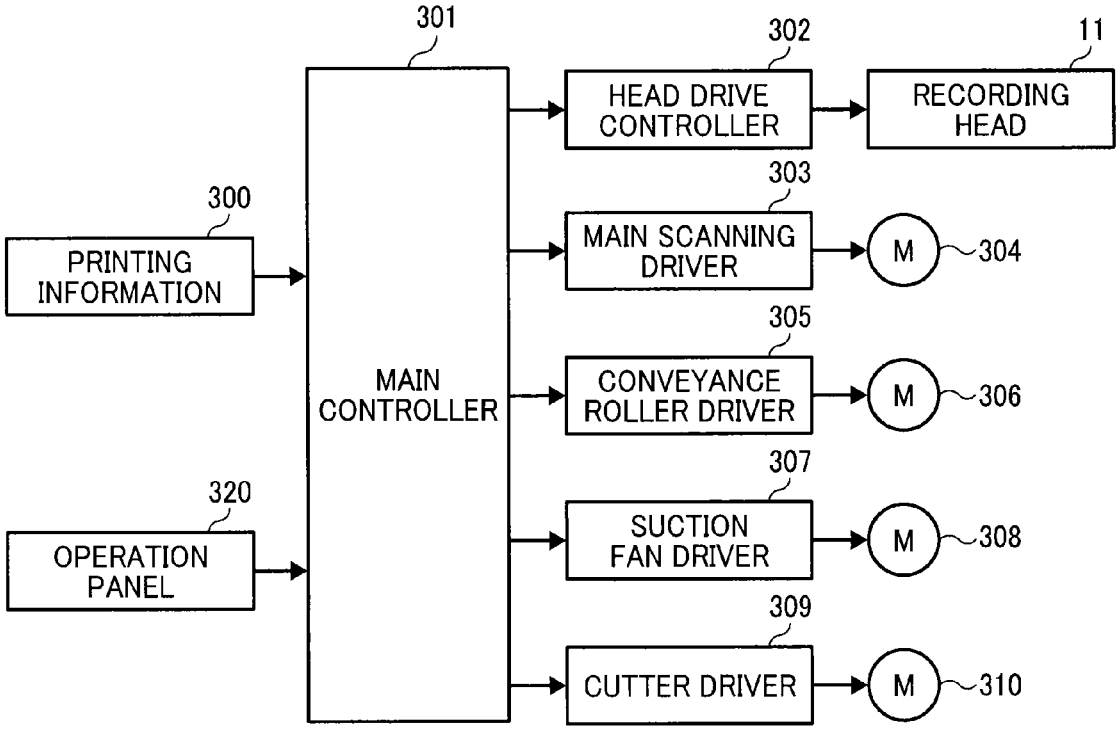
FIG. 3 is block diagram of a controller of the image forming apparatus according to one embodiment of the present disclosure.

Next, a general outline of a controller of the image forming apparatus is described with reference to FIG. 3.

The controller includes a main controller 301 also functioning as a suction fan drive controller which drives a suction fan and adjusts power of adsorption according to embodiments of the disclosure, a head drive controller 302, a main-scanning driver 303, a conveyance roller driver 305, a suction fan driver 307, a cutter driver 309, and the like.

The main controller 301 includes a central processing unit (CPU), a read-only memory (ROM) and a random access memory (RAM), a microcomputer such as an input/output (I/O) unit, a volatile random access memory (VRAM), an application specific integrated circuit (ASIC), and the like. Alternatively, the main controller 301 may be implemented using conventional circuitry, programmable circuitry, an ASIC, or a programmable logic array, for example.

To the main controller 301, printing information 300 from a host is input. In order to form an image according to the printing information 300 on the printing medium 2, the main controller 301 controls driving of a conveyance motor 306 by using the conveyance roller driver 305 to rotate the conveyance roller 22 to intermittently convey the print medium 2 while pulling the print medium 2 out of the roll 4. The main controller 301 controls driving of a main scanning motor 304 with the main-scanning driver 303 to cause the carriage 12 to move and scan in the main scanning direction while controlling driving of the recording heads 11 with the head drive controller 302 to cause the recording heads 11 to eject liquid droplets.

While the conveyance roller 22 is driven for rotation to send the print medium 2, a suction fan motor 308 is controlled for driving with the suction fan driver 307 to rotate the suction fan 27 to attract the print medium 2 onto the protective belt 21.

As for the discharge roller 36, drive is transmitted from the conveyance roller 22 to drive the conveyance motor 306 for rotation to thereby rotate the discharge roller 36 as well.

Then, the main controller 301 drives a cutter motor 310 to move the cutter 31*a* of the cutter unit 31 in the main scanning direction with the cutter driver 309 to cut the print medium 2, on which the image is formed, into desired lengths, thus obtaining the pieces of print medium (label pieces) 200. In addition, an operation panel (operation unit) 320 is connected to the main controller 301.

Figure 4:
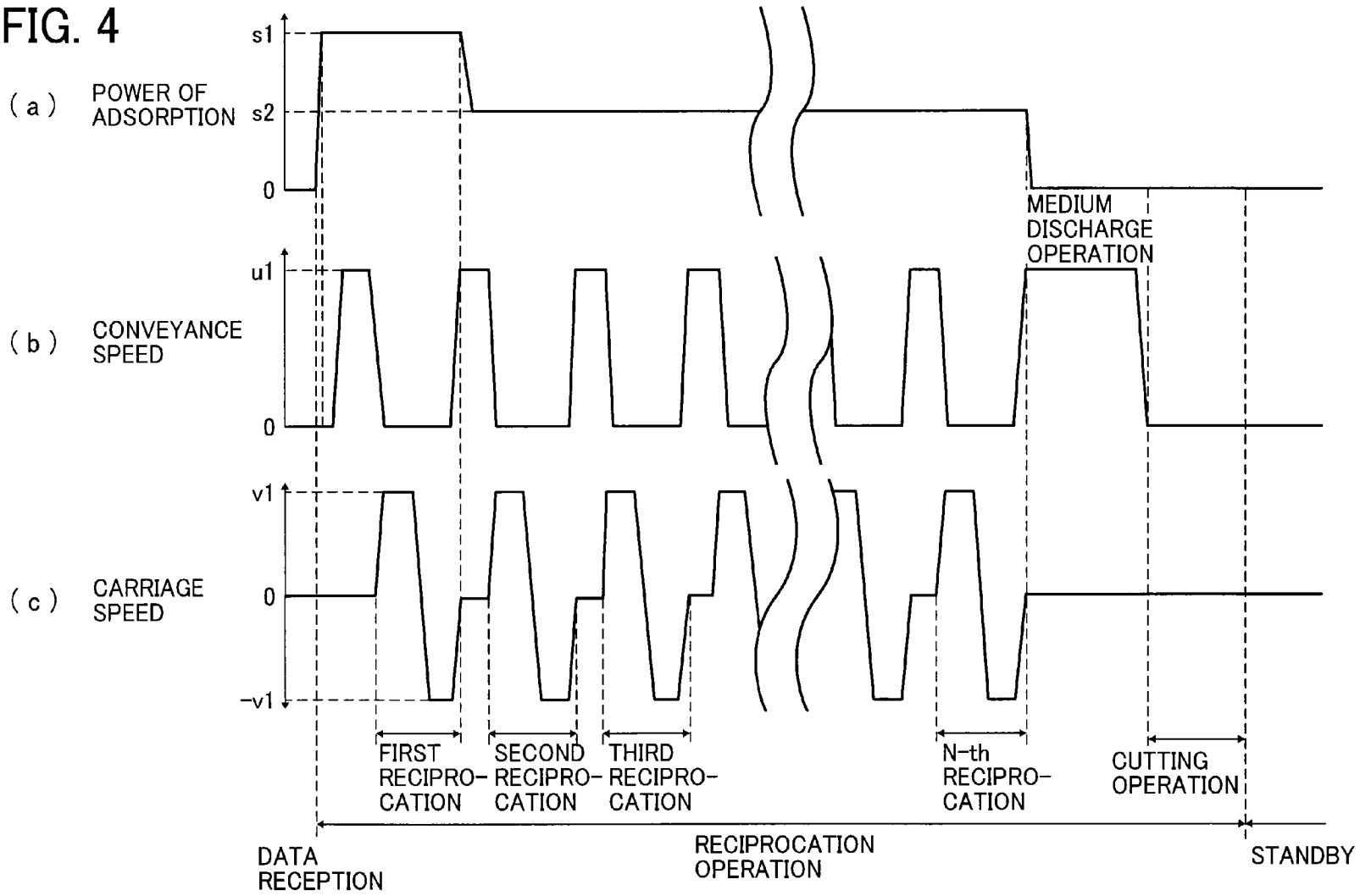
FIG. 4 is a chart illustrating drive control of a carriage, a conveyance roller, and the suction fan by the main controller according to one embodiment of the present disclosure.

Next, the first embodiment of the present disclosure is explained with reference to FIG. 4. FIG. 4 is a chart with which drive control of the carriage 12, the conveyance roller 22, and the suction fan 27 by the main controller in the first embodiment is explained.

First, when the main controller 301 receives printing information 300, the main controller 301 starts drive of the suction fan 27, and gives it rotational speed so that a power of adsorption by the suction fan 27 becomes s1, as shown in FIG. 4 (*a*). The power of adsorption s1 is set as larger than the power of adsorption s2 in the state that all suction holes 21*a* corresponding to the suction fan 27 of the protective belt 21 are closed by a print medium 2. According to one embodiment, s1 is 172 Pa which results from a fan speed of 5,700 RPMs and s2 is 120 Pa which is about 70% of s1, and results from a fan speed of 4,000 RPMs.

Then, when the power of adsorption by the suction fan 27 reaches the power of adsorption s1, as shown in FIG. 4 (*b*), the main controller 301 starts drive of the conveyance roller 22 and the print medium 2 is conveyed to the position at which an image is formed by the first reciprocation (main scanning) of the carriage 12.

Then, the first reciprocation of the carriage 12 is performed, and an image is formed on the print medium 2, as shown in FIG. 4 (*c*).

Then, when the first reciprocation of the carriage 12 is finished, as shown in FIG. 4 (*b*), the main controller 301 starts drive of the conveyance roller 22 and the print medium 2 is conveyed to the position at which an image is formed by the second reciprocation (main scanning) of the carriage 12.

At this time, as shown in FIG. 4 (*a*), the rotational speed of the suction fan 27 is decreased and the power of adsorption by the suction fan 27 is changed into the state of becoming the power of adsorption s2 (s2<s1).

Then, the second reciprocation of the carriage 12 is performed, and an image is formed on the print medium 2, as shown in FIG. 4 (*c*).

From then, the power of adsorption by the suction fan 27 keeps the power of adsorption S2 until the n-th reciprocation of the carriage 12 by which an image forming operation is finished.

After the image forming operation is finished, drive of the suction fan 27 is stopped as shown in FIG. 4 (*a*), and continuous drive of the conveyance roller 22 is carried out, as shown in FIG. 4 (*b*), so that a medium discharging operation is performed. Then, the print medium 2 is cut by cutter unit 31 and becomes label pieces 200.

The control described above is explained with reference to FIG. 5 to FIG. 7. FIG. 5A to FIG. 7B are front views illustrating a part of the first embodiment.

Figure 5A:
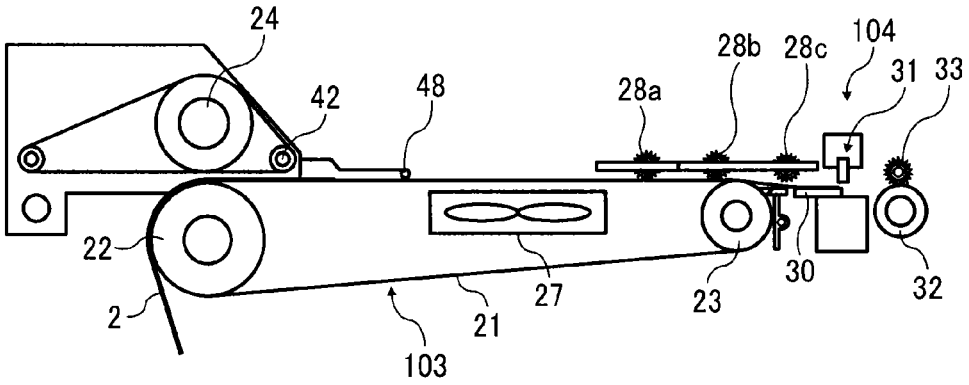
FIGS. 5A, 5B and 5C are a series of front views illustrating a part of an image forming apparatus according to one embodiment of the present disclosure.

The main controller 301 makes the suction fan 27 rotate at the rotational speed from which the power of adsorption s1 is obtained, when printing information 300 is received where the print medium 2 is set as shown in FIG. 5A. Then, when the power of adsorption by the suction fan reaches the power of adsorption s1, as shown in FIG. 5B, the medium conveyance operation which conveys the print medium 2 in the direction of an arrow A is started.

Figure 5B:
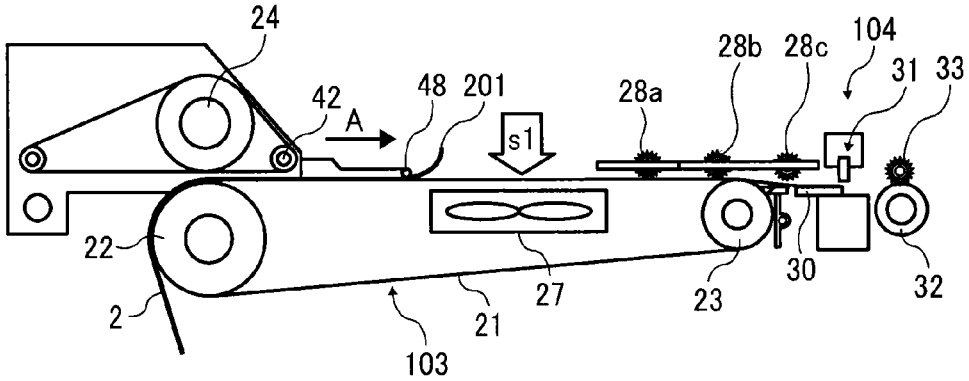
Figure 5C:
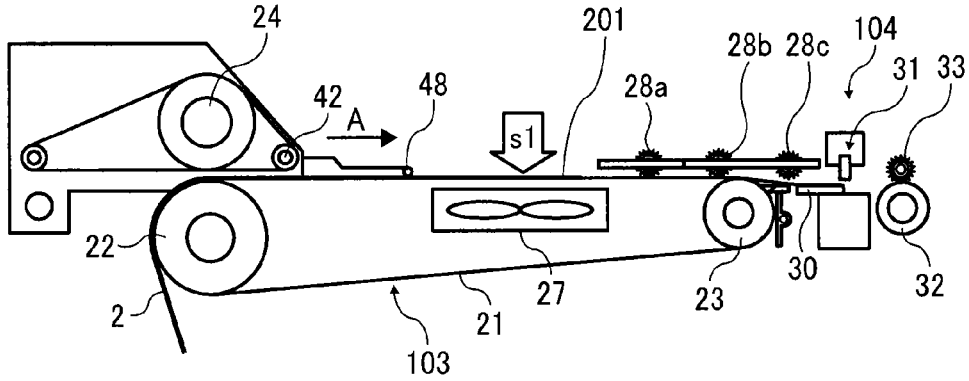
Figure 6A:
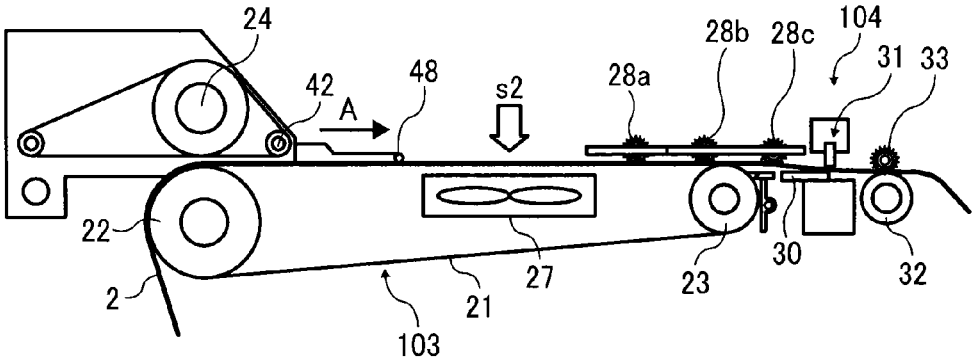
FIGS. 6A, 6B and 6C are a series of front views illustrating a part of an image forming apparatus according to one embodiment of the present disclosure.
Figure 6B:
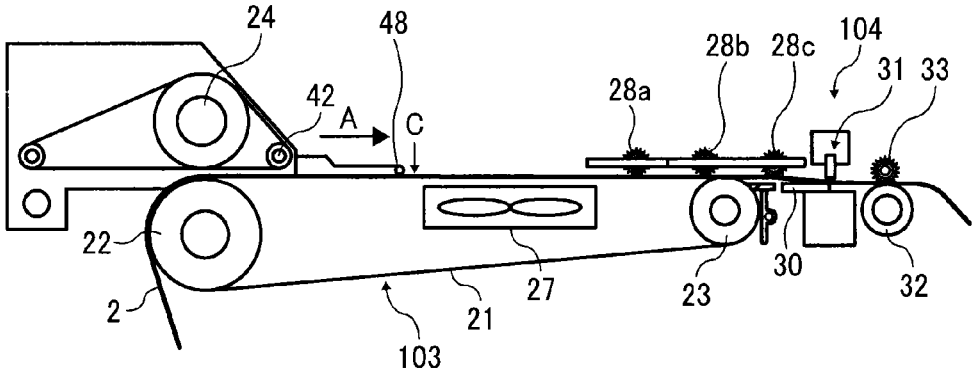
Figure 6C:
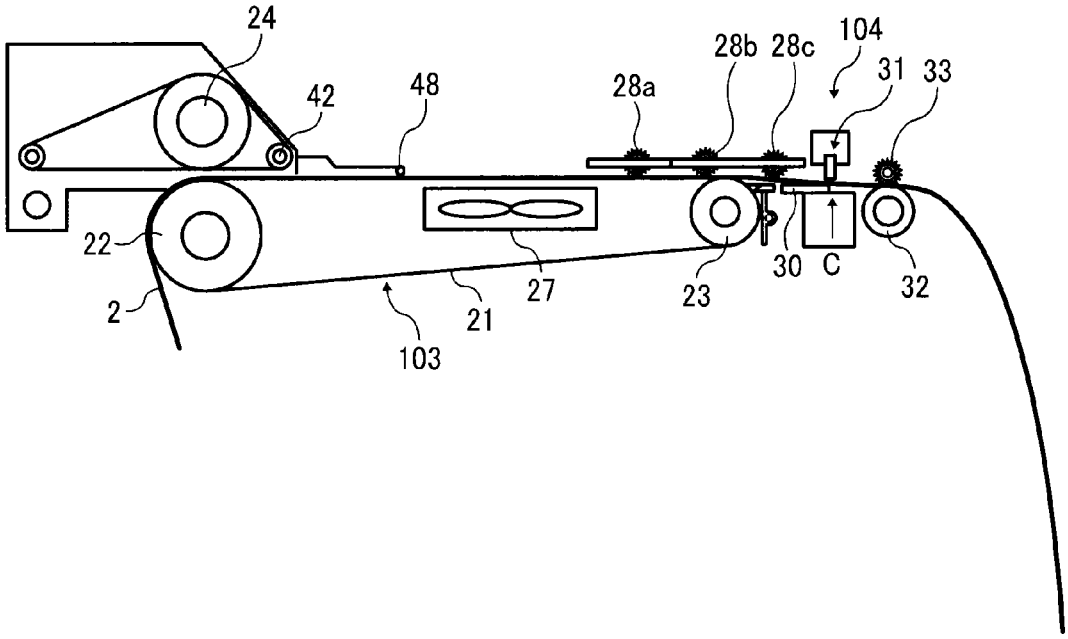

At this time, even if the leading edge portion 201 of the print medium 2 has curved as shown in FIG. 5B, the leading edge portion 201 of the print medium 2 is adsorbed to the protective belt surface by attracting the print medium 2 by the strong power of adsorption s1 as shown in FIG. 5C. Then, it can be conveyed to the position at which the carriage 12 can perform the first reciprocation operation (it is written as "first reciprocation" in FIG. 4). Then, in the reciprocation operation after the second reciprocation operation, the main controller 301 makes the rotational speed of the suction fan be lower and reduces the power of adsorption to the power of adsorption s2 as shown in FIG. 6A, and drive of the suction fan 27 is stopped after the end of the image forming operation. Then, as shown in FIG. 6C, the print medium 2 is conveyed so that the cut position C of the print medium shown in FIG. 6B may arrive at the cutting position by the cutter unit 31.

Figure 7A:
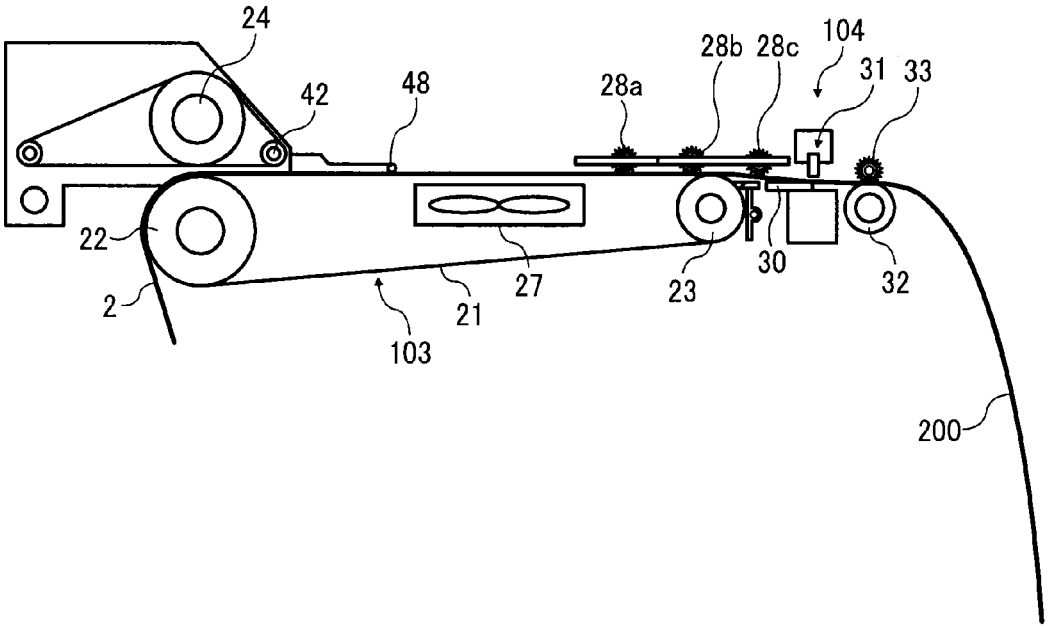
FIGS. 7A and 7B are a series of front views illustrating a part of an image forming apparatus according to one embodiment of the present disclosure.

Furthermore, as shown in FIG. 7A, the print medium 2 is cut by the cutter unit 31, and the label piece 200 is formed. The label piece 200 is held by applying pressure and is maintained between the discharge roller 32 and the spur roller group 33.

Figure 7B:
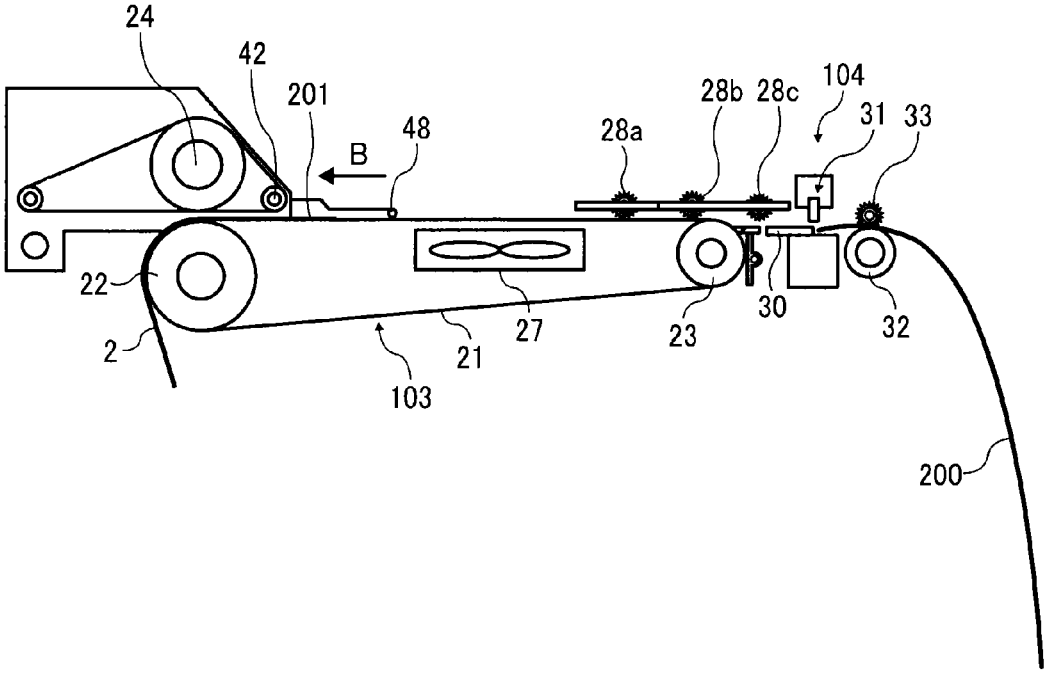

Then, in order to perform the next image formation operation, the print medium 2 is pulled back in the direction of an arrow B as shown in FIG. 7B. By performing the above-mentioned control, the curvature of the leading edge of the print medium can be reduced and the print medium can be conveyed stably.

Figure 8:
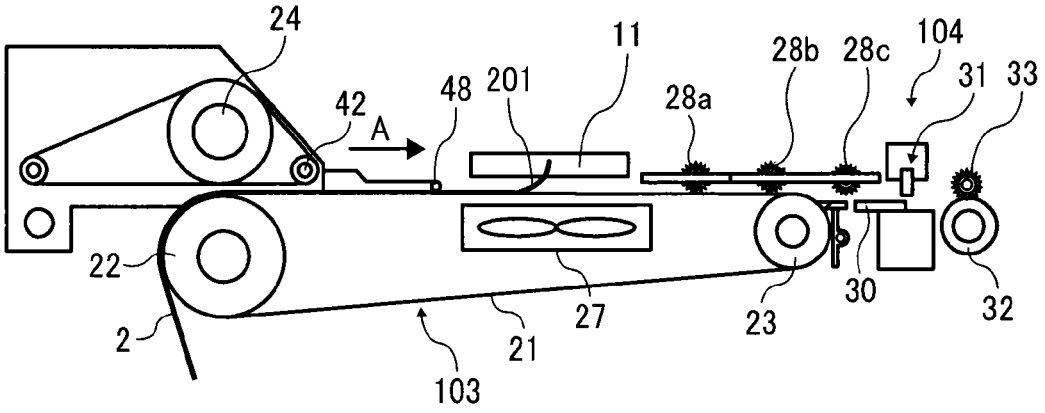
FIG. 8 is a front view illustrating a part of an image forming apparatus which conveys a print medium which has curl in the leading edge portion according to the comparative example.

As shown in FIG. 8, when the image formation operation is performed on the print medium 2 which has curl in the leading edge portion 201, the print medium 2 rubs the recording heads 11 and degradation of image quality and a paper jam are caused. The leading edge portion 201 of the print medium 2 can be prevented from losing contact with the protective belt 21 by strengthening power of adsorption by the suction fan 27. Here, the curl of leading edge portion 201 of print medium 2 occurs for various reasons, for example, peculiar winding curl of print medium 2 which is held as a roll body. Especially in the case of using the rolled linerless label sheet, the leading edge portion 201 of the print medium 2 curls easily by a tearing off force because the adhesive surface 2*b* of the print medium 2 is held adhering to the roll body itself. Therefore, when using linerless label sheet, curl of the leading edge portion 201 of the print medium 2 occurs easily, and the amount of curl also becomes large easily.

On the other hand, increasing the power of adsorption of the suction fan 27 causes loud noise because the suction fan's sound of operation becomes large. In addition, with the linerless label sheet, the adhesive surface 2*b* adheres to the protective belt 21 and the separability of the linerless label sheet from the protective belt 21 worsens, when the adhesive surface 2*b* continues to be adsorbed on protective belt 21 by the strong power of adsorption.

Therefore, in this embodiment, after the image formation by the first reciprocation operation is completed, the power of adsorption by the suction fan 27 is reduced until the time of the second reciprocation operation. Thereby, the noise is suppressed and when the linerless label sheet is used, the deterioration of the separability from the protective belt 21 of the linerless label sheet is prevented.

Here, the adsorption to the protective belt 21 of the print medium 2 has a characteristic which can be kept adsorbing by the minimum required power of adsorption s2, once the print medium is adsorbed by the power of adsorption s1. That is, the power of adsorption s1 is required at first because a space is between the protective belt 21 and the print medium 2. That is, the power of adsorption s1 is required at first because a space is between the protective belt 21 and the print medium 2. However, once adsorption is possible, the power of adsorption can be lowered from the power of adsorption s1, because the space is lost between the protective belt 21 and the print medium 2 and the print medium 2 can be kept adsorbing the protective belt 21 by the power of adsorption s2.

Moreover, when there is no space between the protective belt 21 and the print medium 2, a domain where the suction fan 27 is located is covered by the print medium 2. Thus, a negative pressure becomes easy to be generated in the domain where the suction fan 27 is located, and the rotational speed of the suction fan 27 for producing required power of adsorption can be reduced.

Thus, the noise can be made small enough by lowering the power of adsorption by the suction fan 27 at an early stage, and when the linerless label sheet is used, the deterioration of the fissility from the protective belt 21 of the linerless label sheet can be prevented.

Moreover, like this embodiment, because the discharge roller 32 and the spur roller group 33 which is means to apply pressure on the print medium 2 are arranged and can hold the print medium 2, the suction fan 27 can be stopped at the time of cutting of the print medium 2. Thereby, when performing cutting operation by the cutter unit 31, the print medium 2 can be cut straight certainly without the vibration caused by the suction fan 27. In this case, because tension can be given to the print medium 2 by making a rotational speed of the discharge roller 32 faster than the conveyance speed by the protective belt 21, the print medium 2 can be cut straight more certainly at the cutting operation after the suction fan 27 has stopped.

Figure 9:
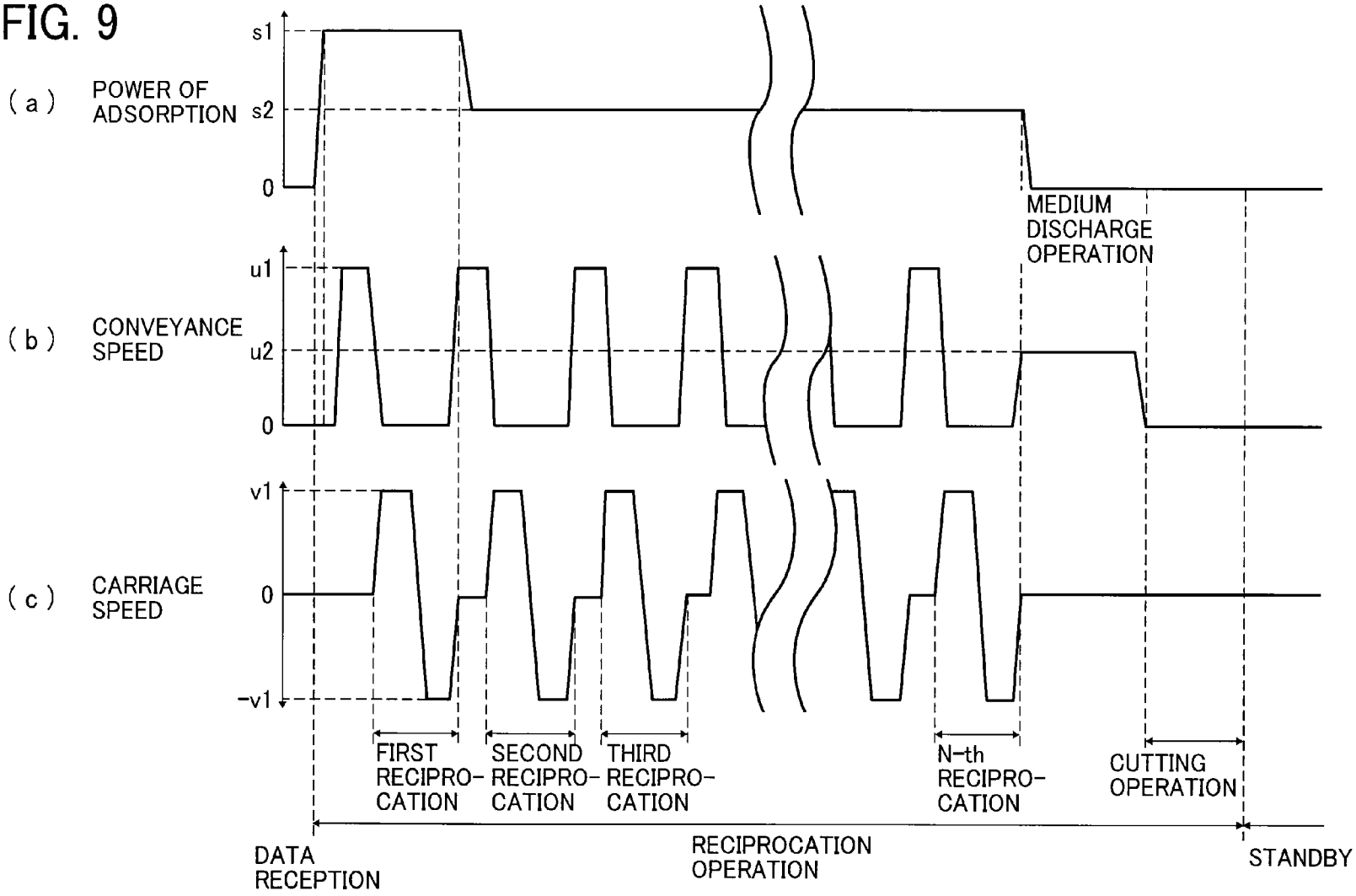
FIG. 9 is a chart illustrating a drive control of a carriage, a conveyance roller, and the suction fan by the main controller according to another embodiment of the present disclosure.

Next, the second embodiment of the present disclosure is explained with reference to FIG. 9. FIG. 9 is a chart with which drive control of the carriage 12, the conveyance roller 22, and the suction fan 27 by the main controller in the second embodiment is explained. In this embodiment, the conveyance speed u2 in performing the medium discharge operation is reduced rather than the conveyance speed u1 in performing imaging forming operation (u2<u1).

With the rolled linerless label sheet, since it is necessary to tear off an adhesive surface 2*b* from the roll body itself when pulling out the print medium 2, noise caused by tearing off occurs. When the usual intermittent print medium conveyance is performed, since the amount of conveyance is small, the noise caused by tearing off is small, either. However, when the print medium is conveyed by a large amount during the medium discharge operation, a noise of the considerable volume occurs because the adhesive surface 2*b* is torn off suddenly and continuously. With this embodiment, the noise caused by tearing off can be reduced more by reducing the conveyance speed in the medium discharge operation rather than the conveyance speed in the imaging forming operation.

In addition, the main controller 301 can perform a more efficient drive by controlling the power of adsorption by the suction fan 27 based on detected temperature and humidity, since the quantity of the curvature (curl) of print medium 2 changes with temperature or humidity. Specifically, since it is easy to curl at the time of low-temperature and low humidity and hard to curl at the time of high temperature and high humidity, the power of adsorption by the suction fan 27 may be lowered at the time of high temperature and high humidity.

Moreover, the power of adsorption may be adjustable by the operation panel 320 or host computer. Thereby, for example, the power of adsorption by the suction fan 27 can be controlled to be small when the noise is loud, and the power of adsorption by the suction fan 27 can be controlled strong when the print medium is rubbing against the recording head.

Thereby, for example, the power of adsorption by the suction fan 27 can be adjusted to be small when the noise is loud, and the power of adsorption by the suction fan can be adjusted to be strong when the print medium rubs against the recording head. Moreover, since it is easy to adsorb the print medium with thin thickness, the power of adsorption by the suction fan may be made small, but the print medium with conversely thick thickness needs to have the power of adsorption increased by the suction fan in order to tend to attach a peculiar winding curl which is held as a roll body. Thus, it becomes possible to make it adapted for a print medium with various characteristics. According to one embodiment at maximum speed, the fan produces about 39 dB of noise. A softer fan noise is 20 dB which results from a fan speed of 4,000 RPMs.

The above-described embodiments use the linerless label sheet with no release liner attached thereto. The present disclosure, however, is similarly applicable to a rolled print medium having an adhesive surface with a release liner, a rolled sheet with no adhesive surface and a not-rolled sheet, for example. In the present specification, the term "image formation" refers to providing a medium with a meaningful image such as a character or a figure and also providing a medium with a meaningless image such as a pattern (i.e., simple ejection of liquid droplets onto a medium). Further, the term "ink" is not limited to so-called ink, and is used to collectively refer to various types of liquids with which the image formation is performed, such as recording liquid, fixing liquid, and toner. Further, the image forming apparatus includes both a serial-type image forming apparatus and a line-type image forming apparatus.

According to one aspect of the present disclosure, a curvature of a leading edge of a print medium can be reduced and the print medium can be prevented from rubbing against print heads. That is, an image forming apparatus includes an image forming device configured to form an image on a print medium by reciprocation operation; and a conveying device configured to hold other surface of the image forming surface of the print medium, and to convey the print medium, the conveying device including. The conveying device includes a belt-formed member that holds the print medium; a suction fan that adsorbs air through suction holes arranged in the belt-formed member; and the fan drive controller that drives the suction fan and adjusts power of adsorption by the suction fan. The fan drive controller performs control which makes the power of adsorption for the first reciprocation movement of the image forming device stronger than the power of adsorption for the second reciprocation movement of the image forming device.

According to another aspect of the present disclosure, a curvature of a leading edge of a print medium can be reduced and the print medium can be more certainly prevented from rubbing against print heads. That is, the power of adsorption for the first reciprocation is set as larger than the power of adsorption in a state that all adsorption holes corresponding to the suction fan are closed by the print medium.

According to yet another aspect of the present disclosure, a curvature of a leading edge of a print medium can be reduced more easily. That is, the control to make the power of adsorption strong may be control which increases the rotational speed of the suction fan.

According to yet another aspect of the present disclosure, a noise with the conveyance of a print medium can be reduced.

That is, the conveyance speed by the belt is reduced, when the reciprocation operation is completed.

According to yet another aspect of the present disclosure, a noise with drive of a suction fan can be reduced. That is, a discharge roller that is placed in a medium conveyance direction downstream side of the belt-formed member; and a pressing member applies pressure on the print medium on the discharge roller. The suction fan is stopped in a state that the print medium is held by the discharge roller and the pressing member, when the conveyance operation is completed.

According to yet another aspect of the present disclosure, tension can be given to a print medium and stable conveyance is enabled. That is, a rotational speed of the discharge roller is faster than the conveyance speed by the belt-formed member.

According to yet another aspect of the present disclosure, a curvature of a leading edge portion of a print medium by load of the tearing off because of the print medium adhering to the roll body itself can be reduced. That is, the print medium is a rolled label sheet which has an adhesive surface with no backing sheet attached to the adhesive surface, and the conveying device conveys the print medium of which the adhesive surface is protected by the belt-formed member.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

The above-described embodiments and effects thereof are illustrative only and do not limit the present disclosure. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

The invention claimed is:

1. An image forming apparatus comprising:

an image forming device to form an image on a first surface of a print medium using a reciprocation operation which causes movement in a direction substantially perpendicular to a direction of conveying the print medium;

a conveying device to hold a second surface of the print medium which is opposite to the first surface, and to convey the print medium, the conveying device including:

a belt that includes holes and transports the print medium, and a fan that adsorbs air through the holes of the belt; and a controller that controls a power of adsorption of the fan, the controller controlling the power of adsorption for both a medium conveyance operation which conveys a leading edge of the medium to a position of a first reciprocation movement and a first reciprocation movement of the image forming device to be stronger than the power of adsorption for a second reciprocation movement of the image forming device, when forming an image on the first surface of the print medium.

2. The image forming apparatus according to claim 1, wherein the controller controls the power of adsorption for the first reciprocation is set as large as the power of adsorption in a state that all holes corresponding to the fan are blocked by the print medium.

3. The image forming apparatus according to claim 1, wherein the controller controls the power of adsorption to increase by increasing a rotational speed of the fan.

4. The image forming apparatus according to claim 1, further comprising:

a controller to reduce a conveyance speed of the belt when the reciprocation operation is completed and the print medium is being conveyed.

5. The image forming apparatus according to claim 1, further comprising:

a discharge roller which is downstream of the belt relative to a medium conveyance direction during image forming, and a pressing member that applies pressure on the print medium on the discharge roller, wherein the controller stops the fan when the print medium is held by the discharge roller and the pressing member, when a conveyance operation is completed.

6. The image forming apparatus according to claim 5, wherein a rotational speed of the discharge roller is faster than a conveyance speed of the belt.

7. The image forming apparatus according to claim 1, wherein the print medium includes a rolled label sheet which has an adhesive surface with no backing sheet attached to the adhesive surface, and the belt transports the rolled label sheet.

8. A method of controlling a printer, comprising:

transporting a leading edge of a medium to a position at which a first reciprocating movement of a print head occurs while the medium is sucked onto a belt using suction through holes in the belt using a first force;

printing on the medium by moving the print head along a carriage, which is substantially perpendicular to a transport direction of the medium, a first time while the print medium is sucked onto the belt using suction through the holes in the belt using the first force;

printing on the print medium by moving the print head along the carriage a subsequent time while the print medium is sucked onto the belt through the holes in the belt using a second force which is less than the first force.

9. The method according to claim 8, wherein:

the first force is as large as a power of adsorption when all holes of the belt corresponding to a suction region of the belt are blocked by the print medium.

10. The method according to claim 8, wherein:

the first force and the second force are controlled by controlling a rotation speed of a fan.

11. The method according to claim 8, further comprising:

reducing a conveyance speed of the belt, after the first and subsequent movement of the print head, while the medium is being conveyed.

12. The method according to claim 8, further comprising:

stopping the sucking onto the belt when the medium is held between a discharge roller and a pressing member, when a conveyance operation is completed.

13. The method according to claim 12, wherein:

a rotational speed of the discharge roller is faster than a conveyance speed of the belt.

14. The method according to claim 8, wherein:

the medium is a rolled label sheet with adhesive on a back thereof without a backing sheet attached to the back of the label sheet, and the belt transports the rolled label sheet.

* * * * *